US005975791A

United States Patent [19]

McCulloch

[11] Patent Number: 5,975,791

[45] Date of Patent: Nov. 2, 1999

[54] VEHICLE SECURITY GATE APPARATUS AND METHOD OF OPERATING SAME

[76] Inventor: G. Wallace McCulloch, 1220 Santa Cruz Ave., Titusville, Fla. 32780

[21] Appl. No.: 08/807,257

[22] Filed: Mar. 4, 1997

[51] Int. Cl.[6] ..... E01F 13/06; E01F 13/08

[52] U.S. Cl. ..... 404/6; 49/33; 49/49; 49/131

[58] Field of Search ..... 49/33, 49, 60, 49/131; 404/6; 256/1, 13.1

[56] References Cited

U.S. PATENT DOCUMENTS

| | | | |
|---|---|---|---|
| 4,576,509 | 3/1986 | Beaty, Sr. . | |
| 4,647,246 | 3/1987 | Brink et al. . | |
| 4,759,655 | 7/1988 | Gorlov | 404/6 |
| 4,818,137 | 4/1989 | Gorlov . | |
| 4,826,349 | 5/1989 | Nasatka . | |
| 4,828,424 | 5/1989 | Crisp, Sr. . | |
| 4,850,737 | 7/1989 | Nasatka et al. . | |
| 4,861,185 | 8/1989 | Eikelenboon . | |
| 4,923,327 | 5/1990 | Gorlov . | |
| 5,026,203 | 6/1991 | Gorlov . | |
| 5,549,410 | 8/1996 | Beryozkin et al. | 404/6 |
| 5,704,730 | 1/1998 | Burton-Chambers | 404/6 |

*Primary Examiner*—James A. Lisehora

*Attorney, Agent, or Firm*—Allen, Dyer, Doppelt, Milbrath & Gilchrist, P.A.

[57] ABSTRACT

A vehicle security gate apparatus and methods are provided for inhibiting undesired access to a protected area. The vehicle security gate apparatus preferably has a barricade adapted to be positioned adjacent a roadway to thereby block vehicle passage along the roadway into an area desired to be protected. The apparatus also preferably has a barricade rotating mount connected to the barricade for rotating the barricade about a predetermined axis so that the barricade rotates about the predetermined axis between a vehicle passage position which allows a desired vehicle to readily pass along the roadway into the protected area, a vehicle blocking position which blocks the roadway so as to inhibit an undesired vehicle from readily entering into the protected area, and a vehicle arresting position which arrests an undesired vehicle responsive to an attempt by the undesired vehicle to ram the barricade when the barricade is positioned in the vehicle blocking position.

22 Claims, 4 Drawing Sheets

H
26
2
30
25
31
20
44
50
R
A
V2
51
40
2
20
40
V2
30
31
50
51
53
52

26
42
40

VEHICLE SECURITY GATE APPARATUS AND METHOD OF OPERATING SAME

FIELD OF THE INVENTION

The present invention relates to the field of security systems and, more particularly, to security gates and methods of operating security gates.

BACKGROUND OF THE INVENTION

Over the years, various security gates have been developed for preventing or inhibiting people and vehicles from entrance into areas which are desired to be protected. The security gates are often positioned along a roadway which must be used to transport goods or personnel to and from the protected area. These security gates may or may not include a guard stationed near a security gate who checks personnel or vehicles desiring to enter the protected area. If a guard is not stationed near the gate, and occasionally even if a guard is stationed near the gate, the person or vehicle desiring to enter the protected area requires the use of a key, password, electronic sensing system, or other special access to the protected area.

Nevertheless, criminal-type or terrorist-type attempts continue to occur in order to access these protected areas by attempting to bypass the security gate or security guard. These attempts also can occur in minimal security areas as well, such as parking lots or parking garages. These criminal or terrorist type attempts, for example, can include a vehicle running through or ramming a gate to break a somewhat flimsy barrier to an entrance even when a security guard may be present. Therefore, more substantial, more massive, or more sophisticated barricades have been erected with many of these security gates in order to block access to these protected areas and to prevent or inhibit undesired vehicles running through a gate or ramming a more flimsy barricade. Examples of some of these security gates or barricades can be seen in U.S. Pat. Nos. 4,576,509 by Beaty, Sr. titled "*Security Gate,*" 4,828,424 by Crisp, Sr. titled "*Vehicle Security Barrier*," U.S. Pat. No. 4,850,737 by Nasatka et al. titled "*Hydraulic Spring Vehicle Barricade And Hydraulic Circuit Therefor*," U.S. Pat. No. 4,861,185 by Eikelenboom titled "*Collapsible Road Barrier.*"

These attempts to ram a barricade or security gate, however, can also include even more serious attempts to enter or damage the protected areas, e.g., by a vehicle bomb or by a vehicle military attack,. Accordingly, various security gates and barricades have been developed which arrest or suddenly stop a vehicle from entry into a protected area, particularly to prevent both minimal undesired access activities by people and vehicles and, more particularly, these more serious attempts to enter protected areas.

These attempts at arresting or suddenly stopping a vehicle, for example, can focus on two areas. First, for example as seen in U.S. Pat. No. 4,647,246 by Brink et al. titled "*Vehicle Trap*," attempts have been made to trap or stop an undesired vehicle by having portions of a bridge or roadway which overlie a pit collapse to thereby suddenly lower the undesired vehicle into the pit. These attempts often succeed by hiding the trap from potential criminals or terrorists. In other words, a visible barricade which blocks the pathway of those desiring to enter often is not used. These hidden-type traps can create various problems during use when vehicles which have permission to enter a protected area desire to pass through the security gate. These traps also include risks of collapsing in commercial applications where the trap is hidden by the unsuspecting public users. Also, if a trap is accidently or intentionally triggered, the trap is often difficult to reset. Further, the trap has only one mounting position.

A second example of a vehicle arresting system can be seen in U.S. Pat. Nos. 4,818,137 and 4,923,327 by Gorlov both of which are titled "*Terrorist Vehicle Arresting System*" and U.S. Pat. No. 5,026,203 also by Gorlov titled "*Friction Reduction For Terrorist Vehicle Arresting System.*" These attempts have used a massive turnstile to redirect an undesired vehicle to a crash barrier positioned alongside of the roadway to thereby stop or arrest the undesired vehicle. The vehicle arresting systems of these attempts, however, can be complex to install and operate and require a separate and somewhat complex triggering mechanism to initiate the massive turnstile. If the triggering mechanism fails or the massive turnstile fails to be released properly, for example, the undesired vehicle can still pass into the protected area. Also, these vehicle arresting systems only have one mounting position.

SUMMARY OF THE INVENTION

With the foregoing in mind, the present invention advantageously provides a relatively simple vehicle security gate apparatus and methods for responsively arresting or suddenly stopping vehicles from undesired access to areas desired to be protected. The vehicle security gate apparatus and methods advantageously responsively arrest a vehicle with a force from a barricade corresponding to the same force of the vehicle when attempting to ram the barricade. The vehicle security gate apparatus and methods also advantageously provide at least three positions with the same barricade, namely a vehicle passage position, a vehicle blocking position, and a vehicle arresting position.

More particularly, a vehicle security gate apparatus for inhibiting undesired access to a protected area is provided according to an embodiment of the present invention. The vehicle security gate apparatus preferably has a barricade adapted to be positioned adjacent a roadway to thereby block vehicle passage along the roadway into an area desired to be protected. The apparatus also preferably has barricade rotating means connected to the barricade for rotating the barricade about a predetermined axis so that the barricade rotates about the predetermined axis between a vehicle passage position which allows a desired vehicle to readily pass along the roadway into the protected area, a vehicle blocking position which blocks the roadway so as to inhibit an undesired vehicle from readily entering into the protected area, and a vehicle arresting position which arrests an undesired vehicle responsive to an attempt by the undesired vehicle to ram the barricade when the barricade is positioned in the vehicle blocking position.

The predetermined axis of the positioning or mounting of the barricade rotating means advantageously can extend either generally transverse or generally parallel to the plane of the roadway which extends into the protected area. The vehicle security gate apparatus and methods thereby advantageously provide a plurality of mounting positions for various terrains where the apparatus is desired to be used.

The barricade preferably includes vehicle arresting means and preferably rotates about the predetermined axis in a first rotational direction between the vehicle blocking position which blocks the roadway so as to inhibit an undesired vehicle from readily entering into the protected area and a vehicle passage position which allows a desired vehicle to readily pass along the roadway into the protected area. The barricade also preferably rotates in a second rotational direction between the vehicle blocking position and a vehicle arresting position which arrests an undesired vehicle with the vehicle arresting means responsive to an attempt by the undesired vehicle to ram the barricade when the barricade is positioned in the vehicle blocking position. A distal end of the barricade advantageously outwardly rotates in the second rotational direction away from a vehicle during an attempt to ram the barricade when the barricade is in the vehicle blocking position and the proximal end of the barricade which has the vehicle arresting means connected thereto responsively rotates in the second direction inwardly into contact with corresponding proximal portions of the undesired vehicle attempting to ram the barricade to thereby arrest the undesired vehicle.

According to another embodiment of the present invention a vehicle security gate apparatus is also provided for inhibiting undesired access to a protected area. The apparatus of this embodiment preferably has a pair of spaced-apart barricades each adapted to be positioned adjacent and on opposing sides of a roadway to thereby block vehicle passage along the roadway into an area desired to be protected. The apparatus also has a pair of barricade rotating means each respectively connected to only one of the pair of barricades for rotating the barricade about a predetermined axis so that each of the pair of barricades rotates about the predetermined axis between a vehicle passage position which allows a desired vehicle to readily pass along the roadway into the protected area, a vehicle blocking position which blocks the roadway so as to inhibit an undesired vehicle from readily entering into the protected area, and a vehicle arresting position which arrests an undesired vehicle responsive to an attempt by the undesired vehicle to ram the barricade when the barricade is positioned in the vehicle blocking position.

The present invention also advantageously provides methods of operating a barricade positioned adjacent a roadway extending into an area desired to be protected. A method of operating a barricade preferably includes rotating the barricade about a predetermined axis to a vehicle passage position which allows a desired vehicle to readily pass along the roadway into the protected area, rotating the barricade about the predetermined axis to a vehicle blocking position which blocks the roadway so as to inhibit an undesired vehicle from readily entering into the protected area, and rotating the barricade to a vehicle arresting position which arrests an undesired vehicle responsive to an attempt by the undesired vehicle to ram the barricade when the barricade is positioned in the vehicle blocking position.

Another method of operating a barricade according to the present invention preferably includes positioning the barricade in a vehicle blocking position which blocks the roadway so as to inhibit an undesired vehicle from readily entering into the protected area. The barricade is then responsively rotated about a predetermined axis to a vehicle arresting position which arrests an undesired vehicle responsive to an attempt by the undesired vehicle to ram the barricade when the barricade is positioned in the vehicle blocking position.

Still another method of operating a barricade according to the present invention preferably includes positioning the barricade in a vehicle blocking position which blocks the roadway so as to inhibit an undesired vehicle from readily entering into the protected area. The undesired vehicle can then be responsively arrested with a force exerted by the barricade corresponding to the same force with which the undesired vehicle exerts in an attempt by the undesired vehicle to ram the barricade when the barricade is positioned in the vehicle blocking position.

Accordingly, a vehicle security gate apparatus and methods according to the present invention provide a barricade having a plurality of security gate operational positions which block, pass, and arrest vehicles. The vehicle security gate apparatus of the present invention advantageously uses the same barricade to obtain all three security gate operational positions. The apparatus advantageously uses the force with which a vehicle attempts to ram the barricade to thereby apply a responsive counter force with which to arrest the undesired vehicle. The vehicle security gate apparatus and methods accomplish this counter force by advantageously rotating the barricade in the same rotational direction as that to which the barricade ram force is being applied by an undesired vehicle attempting to enter a protected area.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION

The present invention will now be described more fully hereinafter with reference to the accompanying drawings which illustrated preferred embodiments of the invention. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art. Like numbers refer to like elements throughout, and prime and/or double prime notation are used to indicate similar elements in alternative embodiments.

Figures 1, 2:
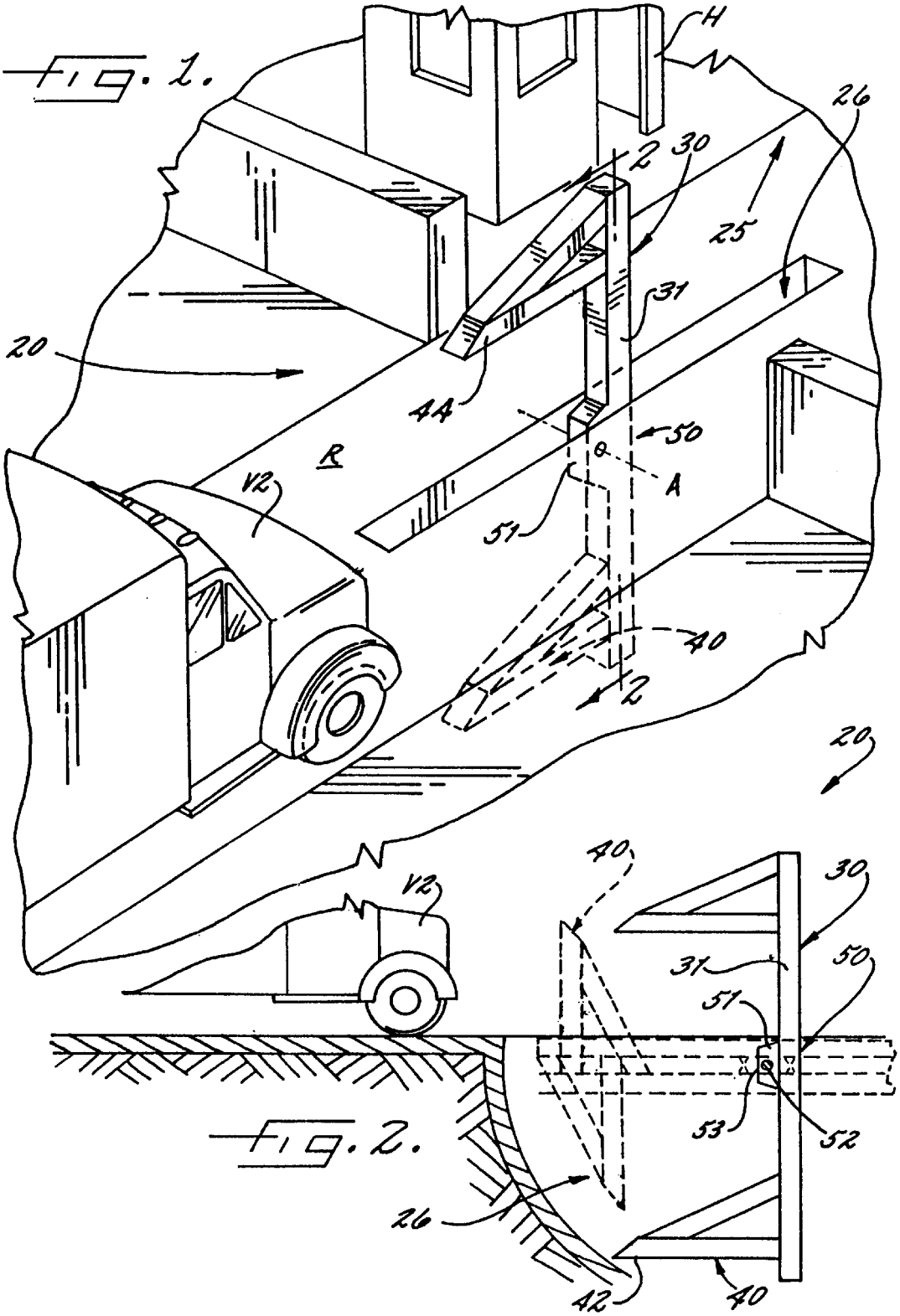
FIG. 1 is an environmental perspective view of a vehicle security gate apparatus in a vehicle blocking position installed at a location for security purposes according to a first embodiment of the present invention.
FIG. 2 is a fragmentary sectional view of a vehicle security gate apparatus in a vehicle blocking position taken along line 2—2 of FIG. 1, and also illustrating a vehicle passage position and a vehicle arresting position in phantom lines, according to a first embodiment of the present invention.

FIG. 1 illustrates a vehicle security gate apparatus 20 for inhibiting undesired access to a protected area 25 is provided according to a first embodiment of the present invention. The vehicle security gate apparatus 20 preferably has a barricade 30 adapted to be positioned adjacent a roadway R to thereby block vehicle passage along the roadway R into an area 25 desired to be protected. The apparatus also preferably has barricade rotating means 50 connected to the barricade 30 for rotating the barricade 30 about a predetermined axis A so that the barricade 30 rotates about the predetermined axis A between a vehicle passage position (see FIG. 3) which allows a desired vehicle VI to readily pass along the roadway R into the protected area 25, a vehicle blocking position (see FIGS. 1–2) which blocks the roadway R so as to inhibit an undesired vehicle V2 from readily entering into the protected area 25, and a vehicle arresting position (see FIG. 4) which arrests an undesired vehicle V2 responsive to an attempt by the undesired vehicle V2 to ram the barricade 30 when the barricade 30 is positioned in the vehicle blocking position.

The predetermined axis A of the positioning or mounting of the barricade rotating means 50 advantageously can extend either generally transverse (see, e.g., FIGS. 5–8), i.e., substantially perpendicular, or generally parallel (see, e.g., FIGS. 1–4) to the plane of the roadway R, e.g., the plane in which the roadway R lies as illustrated. The vehicle security gate apparatus 20 thereby advantageously provides a plurality of mounting positions for various terrains or mounting schemes where the apparatus 20 is desired to be used. As illustrated in the embodiment of the security gate apparatus 20" of FIGS. 8–9, these mounting schemes of the barricade 30, 30", for example, can also include portably mounting the barricade 30" to a vehicle or other structure for readily transporting the barricade 30" to various areas desired to be protected. The barricade 30 therefore, for example, can advantageously be mounted so as to either underlie a roadway, overlie a roadway, extend outwardly from the side peripheries of the roadway, or any combination of these mounting schemes.

The barricade rotating means 50 is connected to a medial portion of the barricade 30 for rotating the barricade 360 degrees in opposing directions about the predetermined axis A. The barricade rotating means 50 preferably is provided by a barricade rotating mount 51 which has an elongate shaft 52 having a lengthwise extent along the predetermined axis A and a shaft housing 53 connected to the barricade 30 and being rotatable about the shaft 52. The mounting of the barricade 30 along a medial portion thereof preferably is a non-centered medial portion so that the barricade 30 rotatingly rests in the vehicle blocking position as illustrated. In this embodiment, the barricade 30 includes an elongate beam 31 that extends upwardly and generally perpendicular to the upper surface of the roadway R. The connecting or mounting of the barricade 30 to the barricade rotating means 50 balances the barricade 30 in at least the vehicle blocking position so as to enhance manual operation of the barricade 30 during rotation of the barricade 30 between the vehicle blocking and vehicle passage positions.

The barricade 30 preferably includes vehicle arresting means 40 and preferably rotates about the predetermined axis A in a first rotational direction, e.g., as indicated by the arrows, between the vehicle blocking position which blocks the roadway R so as to inhibit an undesired vehicle V2 from readily entering into the protected area 25 and a vehicle passage position which allows a desired vehicle V1 to readily pass along the roadway R into the protected area. The barricade 30 also preferably rotates in a second rotational direction, e.g., as indicated by the arrows, between the vehicle blocking position and a vehicle arresting position which arrests an undesired vehicle V2 with the vehicle arresting means 30 responsive to an attempt by the undesired vehicle to ram the barricade 30 when the barricade 30 is positioned in the vehicle blocking position.

The vehicle arresting means 40 preferable is provided by a vehicle piercer 42 for piercing through at least an outer surface of the undesired vehicle V2 so as to stop the forward progression of the undesired vehicle V2 through the barricade 30. A vehicle piercer 42, for example, is illustrated as a triangular shaped beam member connected to the elongate beam 31 that has a sharp or pointed tip for pierce portions of an undesired vehicle V2. It will be understood by those skilled in the art, however, that other configurations of a vehicle piercer 42, e.g., one or more prongs, can be used as well. The vehicle piercer 42, for example, can be advantageous in some types of terrorist applications where a car bomb or other explosive devices are positioned on or around the vehicle V2 so that the piercing may activate the explosives without damage to guarding personnel.

The vehicle arresting means 40 according to the present invention likewise can also be blunted, be formed by only the proximal portion of the main body of the beam 31, e.g., substantially flat, have a plurality of prongs, or have various other configurations which preferably accomplish the operation of arresting or assisting in the arresting of a vehicle V2. Blunted or non-intrusive configurations of the vehicle arresting means 40 can advantageously be used for commercial applications such as parking lots or garages and entrances to corporations which may be concerned about corporate espionage or other criminal activities.

As discussed above, the barricade 30 preferably includes a portion defining a base which is preferably provided by an elongate beam 31 that has a first substantially flat surface and a second surface. The elongate beam 31, for example, is preferably fairly massive and formed of a steel or other heavy metal material to both withstand and inflict damage if desired. The vehicle arresting means 40 preferably is connected to the second surface and extends outwardly therefrom for arresting the undesired vehicle V2. A distal end of the elongate beam 31 also preferably has a vehicle piercer which forms a second vehicle piercer 44 advantageously outwardly rotates in the second rotational direction away from an undesired vehicle V2 during an attempt by the undesired vehicle V2 to ram the elongate beam 31 when the elongate beam 31 is in the vehicle blocking position and the proximal end of the elongate beam 31 which has the vehicle arresting means 40 connected thereto responsively rotates in the second direction inwardly into contact with corresponding proximal portions of the undesired vehicle V2 attempting to ram the barricade 30 to thereby arrest the undesired vehicle V2. A blockade enhancer is connected to the barricade 30 and extends outwardly therefrom, e.g., preferably outwardly from the second vehicle piercer 44, for enhancing the roadway blocking capabilities of the barricade 30 when positioned in the vehicle blocking position. This blockade enhancer preferably is provided by a one-wheel or two-wheel vehicle, e.g., a motorcycle, blocker such as in the form of an elongate rod which extends outwardly from the barricade 30 in a plane generally parallel to the roadway R so as to block the roadway R from a relatively low height to thereby prevent or greatly inhibit motorcycles or the like from readily passing through the barricade 30.

Figure 3:
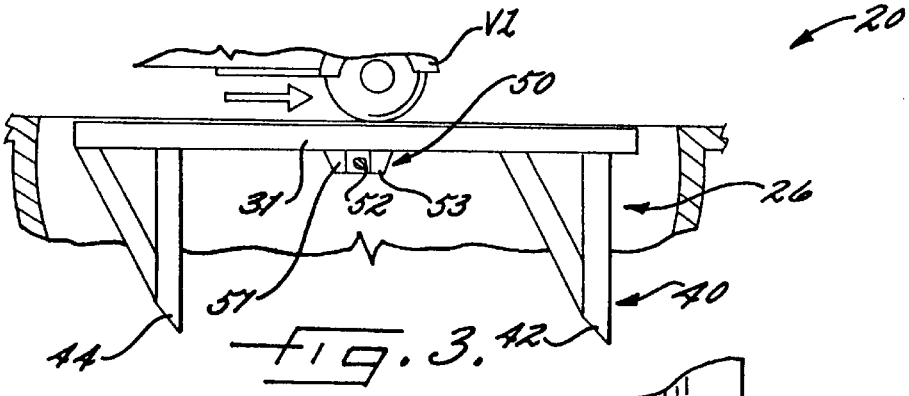
FIG. 3 is a fragmentary sectional view of FIG. 1 having lower portions thereof broken away for clarity to illustrate the underground portions of a vehicle security gate apparatus in a vehicle passage position according to a first embodiment of the present invention.
Figure 4:
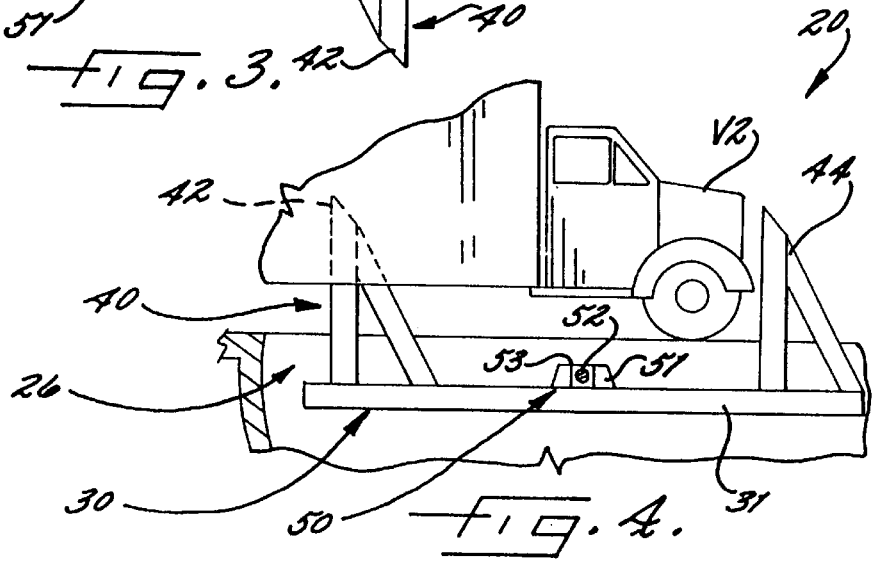
FIG. 4 is a side elevational view of FIG. 1 having lower portions thereof broken away for clarity to illustrate the underground portions of a vehicle security gate apparatus according to a first embodiment of the present invention.

As best illustrated in FIGS. 2–4, a pit 26 is formed in or so as to underlie the roadway R which extends into the protected area 25. The barricade rotating means 50 of this embodiment of the present invention preferably is mounted to the pit 26 so that at least portions of the elongate beam 31 readily rotate into and out of the pit 26. The pit 26 and the elongate beam 31 are each at least relatively narrower than the lateral distance between each of the two pairs of tires of a compact vehicle so that each of the two pair of tires of the compact vehicle can readily pass over the pit 26 and the overlying elongate beam 31 when the barricade 30 is positioned in the vehicle passage position. In the horizontally rotating or pivoting positions, e.g., FIGS. 5–7, an opening 28 in a side wall W or an embankment allows the barricade 30 to rotate freely as described preferably is used instead of the pit 26 as described above.

A vehicle security gate apparatus 20 according to the present invention preferably is positioned adjacent a guard house H or other structure which is reinforced to protectively inhibit guarding personnel from being injured from a vehicle arresting procedure performed by the barricade 30. The guard can advantageously manually operate the barricade 30 in a simple and non-complex manner if the barricade 30 is properly mounted and balanced as described and illustrated. Other barricade operational means such as electronic or mechanical sensors and actuators can be used as well.

Figure 5:
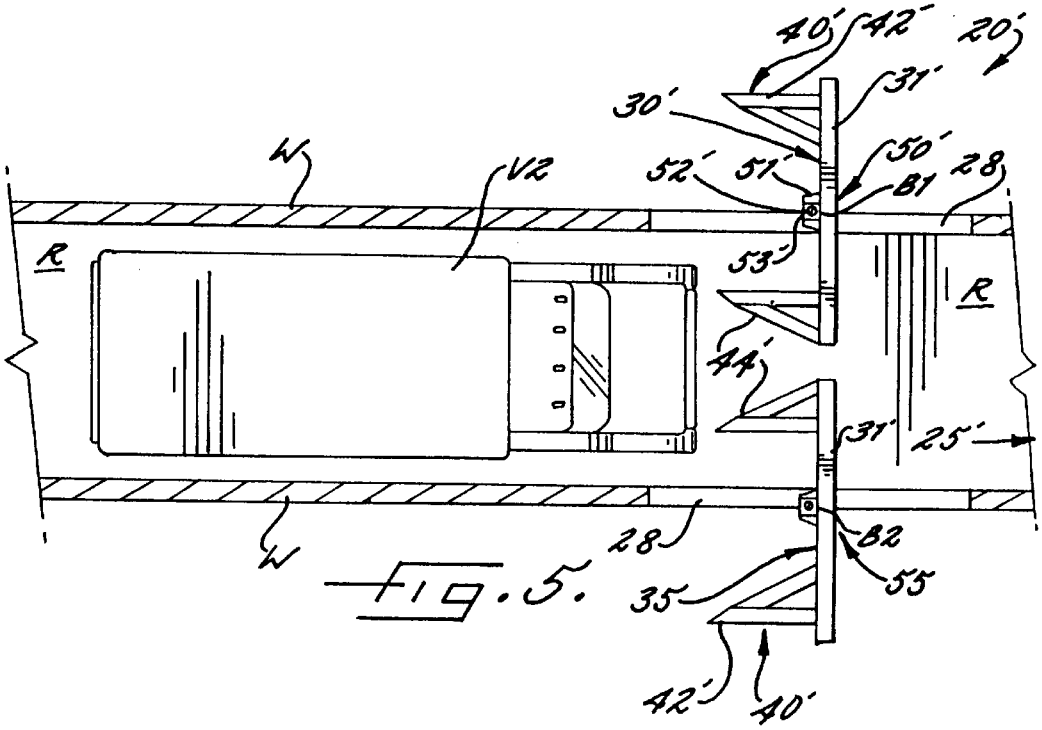
FIG. 5 is a top plan view of a vehicle security gate apparatus in a vehicle blocking position installed at a location for security purposes according to a second embodiment of the present invention.
Figure 6:
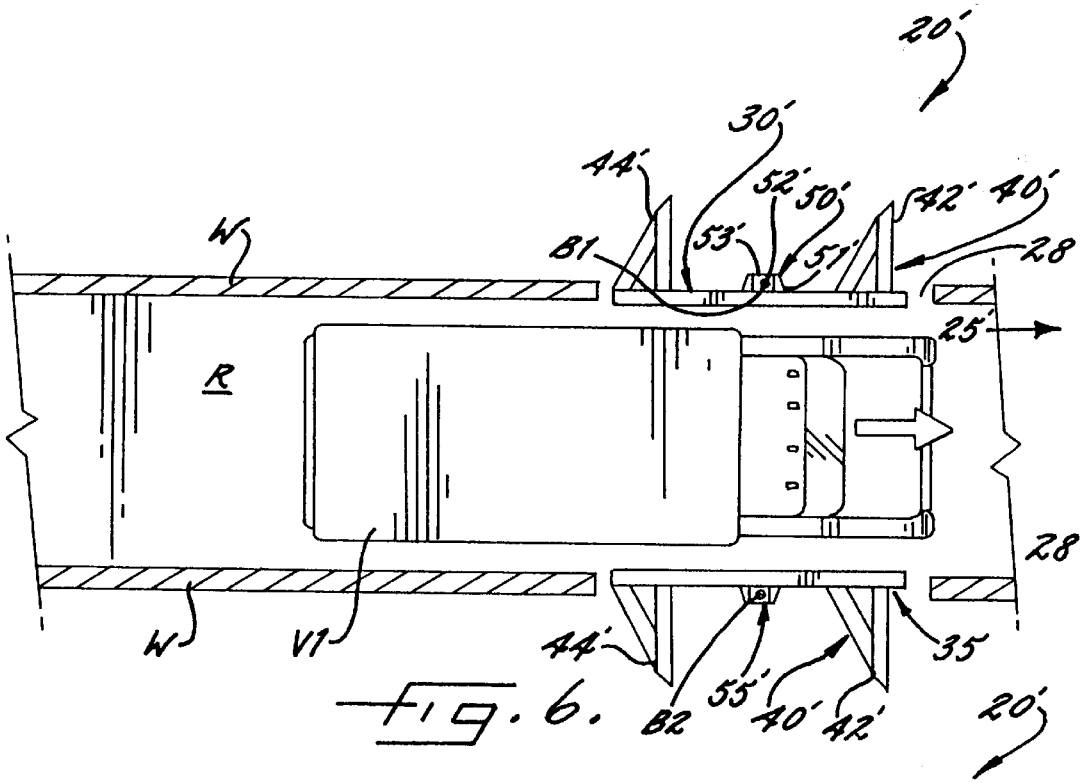
FIG. 6 is a top plan view of a vehicle security gate apparatus of FIG. 5 in a vehicle passage position according to a second embodiment of the present invention.
Figure 7:
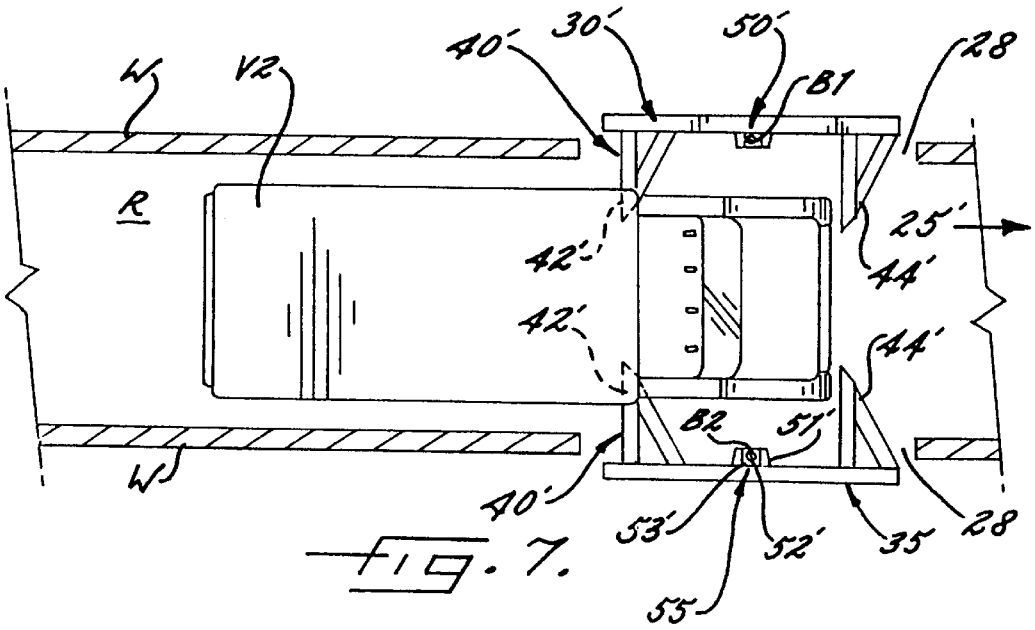
FIG. 7 is a top plan view of a vehicle security gate apparatus of FIG. 5 in a vehicle arresting position according to a second embodiment of the present invention.

As best illustrated in FIGS. 5–7, a vehicle security gate apparatus 20' according to a second embodiment of the present invention is also provided for inhibiting undesired access to a protected area. The apparatus of this embodiment preferably has a pair of spaced-apart barricades 30', 35 each adapted to be positioned adjacent and on opposing sides of a roadway R to thereby block vehicle passage along the roadway R into an area desired to be protected 25. The apparatus 20' also has a pair of barricade rotating means 50', 55 each respectively connected to only one of the pair of barricades 30, 35' for rotating the barricade 30', 35 about a predetermined axis B1, B2 so that each of the pair of barricades 30', 35 rotates about the predetermined axis B1, B2 between a vehicle passage position (see FIG. 6) which allows a desired vehicle V1 to readily pass along the roadway R into the protected area 25', a vehicle blocking position (see FIGS. 5 and 8) which blocks the roadway R so as to inhibit an undesired vehicle V2 from readily entering into the protected area 25', and a vehicle arresting position (see FIG. 7) which arrests an undesired vehicle V2 responsive to an attempt by the undesired vehicle V2 to ram the barricade 30', 35 when the barricade 30', 35 is positioned in the vehicle blocking position. The pair of barricades 30', 35 and the pair of barricade rotating means 50', 55 are constructed, formed, and operated in much the same way as the embodiment described in FIGS. 1–4. Accordingly, for brevity and conciseness, this description of the second embodiment of the apparatus 20' will not repeat the previous description in much greater detail.

Figure 8:
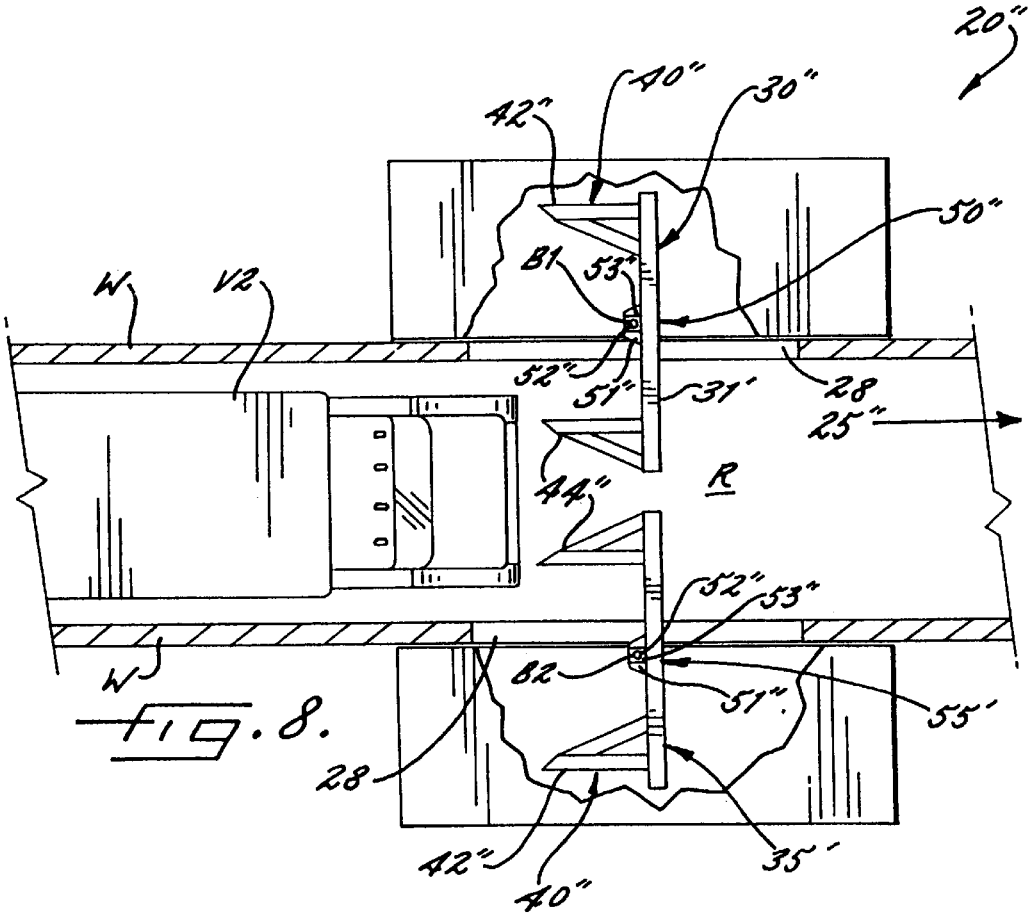
FIG. 8 is a top plan view of a vehicle security gate apparatus having portability aspects installed at a location for security purposes and arranged in a vehicle blocking position according to a third embodiment of the present invention.
Figure 9:
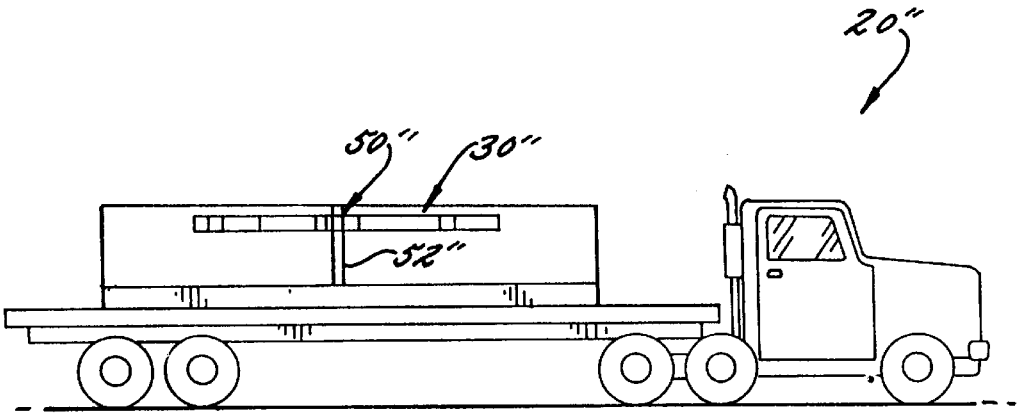
FIG. 9 is a side elevational view of a vehicle security gate apparatus having portability aspects mounted for portably transporting to or from a location for security purposes according to a third embodiment of the present invention.

As best illustrated in FIGS. 7–8, the predetermined axis B1, B2 of each of the pair of barricade rotating means 50', 55 extends generally perpendicular to the plane of the roadway R. Each of the pair of barricades 30', 35 is synchronously positioned so that each of the pair of barricades 30', 35 is positioned in the vehicle passage, the vehicle blocking, and the vehicle arresting positions at substantially the same time. The alignment and synchronous position of the pair of barricades 30', 35 advantageously allows the pair of barricades to arrest an undesired vehicle V2 between the pair of barricades 30', 35 when the vehicle V2 attempts to ram the distal portions thereof.

The apparatus 20' preferably also includes barricade balancing means 70 associated with each barricade 30', 35 for balancing the barricade 30', 35 so that the barricade 30', 35 rotatingly rests in the vehicle blocking position so as to enhance manual operation of the barricade 30', 35 during rotation of the barricade 30', 35 between the vehicle blocking and vehicle passage positions. The barricade balancing means 70 preferably is provided by a slight slope or upgrade in the opening for mounting the barricade 30', 35. It will also be understood by those skilled in the art that other barricade balancing means, such as inclined lower ends of the barricade mount or the barricade rotating means 50', 55, can be used as well according to the present invention.

As illustrated in FIGS. 1–9, and as described above, the present invention also advantageously provides methods of operating a barricade 30 positioned adjacent a roadway R extending into an area 25 desired to be protected. A method of operating a barricade 30 preferably includes rotating the barricade 30 about a predetermined axis A to a vehicle passage position which allows a desired vehicle V1 to readily pass along the roadway R into the protected area 25. The barricade 30 is rotated about the predetermined axis A to a vehicle blocking position which blocks the roadway R so as to inhibit an undesired vehicle V2 from readily entering into the protected area 25. The barricade 30 rotates to a vehicle arresting position which arrests an undesired vehicle V2 responsive to an attempt by the undesired vehicle V2 to ram the barricade 30 when the barricade 30 is positioned in the vehicle blocking position.

The step of rotating the barricade 30 to the vehicle arresting position preferably includes outwardly rotating a distal end of the barricade 30 away from an undesired vehicle V2 during an attempt to ram the barricade 30 when the barricade 30 is in the vehicle blocking position and responsively rotating the proximal end of the barricade 30 inwardly into contact or engagement with corresponding proximal portions of the undesired vehicle V2 attempting to ram the barricade 30 to thereby arrest the undesired vehicle V2. The step of rotating the barricade 30 to the vehicle arresting position includes rotating the barricade 30 in an opposing direction from the direction of rotating the barricade 30 to the vehicle passage position.

Another method of operating a barricade 30 according to the present invention preferably includes positioning the barricade 30 in a vehicle blocking position which blocks the roadway R so as to inhibit an undesired vehicle V2 from readily entering into the protected area 25. The barricade 30 is then responsively rotated about a predetermined axis A to a vehicle arresting position which arrests an undesired vehicle V2 responsive to an attempt by the undesired vehicle V2 to ram the barricade 30 when the barricade 30 is positioned in the vehicle blocking position.

The step of responsively rotating the barricade 30 to the vehicle arresting position preferably includes outwardly rotating a distal end of the barricade 30 away from an undesired vehicle V2 during an attempt to ram the barricade 30 when the barricade 30 is in the vehicle blocking position. The proximal end of the barricade 30 responsively rotates inwardly into contact with corresponding proximal portions of the undesired vehicle V2 attempting to ram the barricade 30 to thereby arrest the undesired vehicle V2. The predetermined axis A of the method advantageously can extend generally transverse to the plane of the roadway R which extends into the protected area 25 or generally parallel to the plane of the roadway R which extends into the protected area 25.

Still another method of operating a barricade 30 according to the present invention preferably includes positioning the barricade 30 in a vehicle blocking position which blocks the roadway R so as to inhibit an undesired vehicle V2 from readily entering into the protected area 25. The undesired vehicle V2 can then be responsively arrested with a force exerted by the barricade 30 corresponding to the same force with which the undesired vehicle V2 exerts in an attempt by the undesired vehicle V2 to ram the barricade 30 when the barricade 30 is positioned in the vehicle blocking position.

Accordingly, a vehicle security gate apparatus 20 and methods according to the present invention provide a barricade 30 having a plurality of security gate operational positions which block, pass, and arrest vehicles. The vehicle security gate apparatus 20 of the present invention advantageously uses the same barricade 30 to obtain all three security gate operational positions. The apparatus 30 advantageously uses the force with which a vehicle attempts to ram the barricade 30 to thereby apply a responsive counter force with which to arrest the undesired vehicle V2. The vehicle security gate apparatus 20 and methods accomplish this counter force by advantageously rotating the barricade 30 in the same rotational direction as that to which the barricade ram force is being applied by an undesired vehicle V2 attempting to enter a protected area 25.

The method also include positioning the barricade 30 in a vehicle passage position which allows a desired vehicle V1 to readily pass along the roadway R into the protected area 25. The barricade 30 preferably is rotatively mounted about a predetermined axis A. The step of positioning the barricade 30 in the vehicle passage position includes rotating the barricade 30 about the predetermined axis A to the vehicle passage position. The step of positioning the barricade 30 in the vehicle blocking position includes rotating the barricade 30 about the predetermined axis A to the vehicle blocking position. The step of responsively arresting the undesired vehicle V2 responsive to an attempt by the undesired vehicle V2 includes rotating the barricade 30 in an opposite direction to the direction of rotation of the barricade 30 to the vehicle passage position. The predetermined axis A extends either generally transverse or generally parallel to the plane of the roadway R which extends into the protected area 25.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. A vehicle security gate apparatus for inhibiting undesired access to a protected area, the apparatus comprising:

a barricade including at least a base having an elongate shape and adapted to be positioned adjacent a roadway so that at least portions of the base thereby block vehicle passage along the roadway into an area desired to be protected; and barricade rotating means connected to a medial portion of the base of said barricade for rotating a portion of the base of said barricade which blocks vehicle passage about a predetermined axis so that the base of said barricade readily rotates 360 degrees in opposing directions about the predetermined axis between a vehicle passage position which allows a desired vehicle to readily pass along the roadway into the protected area, a vehicle blocking position which blocks the roadway so as to inhibit an undesired vehicle from readily entering into the protected area, and a vehicle arresting position which arrests an undesired vehicle responsive to an attempt by the undesired vehicle to ram said barricade when the base of said barricade is positioned in the vehicle blocking position, and wherein the predetermined axis extends generally parallel to the plane of the roadway which extends into the protected area and the connecting of said barricade to said barricade rotating means balances the base of said barricade in at least the vehicle passage and the vehicle blocking positions so as to enhance operation of said barricade during rotation of the base of said barricade between the vehicle blocking and vehicle passage positions.

2. An apparatus as defined in claim 1, wherein said barricade includes vehicle arresting means connected to the base for arresting an undesired vehicle attempting to ram said barricade when the base of said barricade is positioned in the vehicle blocking position.

3. An apparatus as defined in claim 2, wherein the base of said barricade comprises an elongate beam member having a first substantially flat surface and a second surface, said vehicle arresting means of said barricade having a triangular-shaped beam member which includes a pointed tip thereof, said triangular-shaped beam member being connected to the second surface of the elongate beam member and extending outwardly therefrom for arresting the undesired vehicle.

4. An apparatus as defined in claim 3, wherein a distal end of said elongate beam member rotates outwardly away from a vehicle during an attempt to ram said barricade when said elongate beam member of the base of said barricade is in the vehicle blocking position so that the proximal end of said elongate beam member having said vehicle arresting means connected thereto responsively rotates inwardly into contact with corresponding proximal portions of the undesired vehicle attempting to ram said barricade to thereby arrest the undesired vehicle.

5. An apparatus as defined in claim 2, wherein said vehicle arresting means comprises a vehicle piercer for piercing through at least an outer surface of the undesired vehicle so as to stop the forward progression of the undesired vehicle through said barricade.

6. An apparatus as defined in claim 1, wherein said barricade includes an elongate beam member, and the apparatus further comprises an opening defining a pit formed in the roadway into the protected area, said barricade rotating means being mounted to said pit so that at least portions of said elongate beam member readily rotate into and out of said pit, and wherein said pit and said elongate beam member are each at least relatively narrower than the lateral distance between each of the two pairs of tires of a compact vehicle so that each of the two pair of tires of the compact vehicle can readily pass over said pit and said elongate beam member when the elongate beam member of the base of said barricade is positioned in the vehicle passage position.

7. A vehicle security gate apparatus for inhibiting undesired access to a protected area, the apparatus comprising:

a barricade adapted to be positioned adjacent a roadway to thereby block vehicle passage along the roadway into an area desired to be protected, said barricade including a base extending lengthwise in a plane generally parallel to the roadway and vehicle arresting means connected to the base and extending outwardly from the base for arresting an undesired vehicle attempting entrance into the protected area;

barricade rotating means connected to said barricade for readily rotating said barricade 360 degrees in opposing directions about a predetermined axis so that said barricade rotates about the predetermined axis between a vehicle passage position which allows a desired vehicle to readily pass along the roadway into the protected area, a vehicle blocking position which blocks the roadway so as to inhibit an undesired vehicle from readily entering into the protected area, and a vehicle arresting position which arrests an undesired vehicle with said vehicle arresting means of said barricade responsive to an attempt by the undesired vehicle to ram said barricade when said barricade is positioned in the vehicle blocking position and so that a distal end of said barricade rotates outwardly away from a vehicle during an attempt to ram said barricade when said barricade is in the vehicle blocking position and the proximal end of said barricade responsively rotates inwardly into contact with the corresponding proximal portions of the undesired vehicle attempting to ram said barricade to thereby arrest the undesired vehicle; and an opening defining a pit formed in the roadway entering into the protected area, said barricade rotating means being mounted to said pit so that at least portions of an elongate beam member defining the base of said barricade readily rotate into and out of said pit, and wherein said pit and said elongate beam member are each at least relatively narrower than the lateral distance between each of the two pairs of tires of a compact vehicle so that each of the two pair of tires of the compact vehicle can readily pass over said pit and said elongate beam member when said barricade is positioned in the vehicle passage position.

8. An apparatus as defined in claim 7, wherein the predetermined axis extends generally parallel to the plane of the roadway which extends into the protected area.

9. An apparatus as defined in claim 8, wherein said barricade rotating means is connected to a medial portion of said barricade for rotating said barricade 360 degrees in opposing directions about the predetermined axis.

10. An apparatus as defined in claim 9, wherein the medial portion of the mounting of said barricade is a non-centered medial portion so that said barricade rotatingly rests in the vehicle blocking position, and wherein the connecting of said barricade to said barricade rotating means balances said barricade in at least the vehicle passage and the vehicle blocking positions so as to enhance manual operation of said barricade during rotation of said barricade between the vehicle blocking and vehicle passage positions.

11. An apparatus as defined in claim 10, wherein said barricade comprises an elongate beam member having a first substantially flat surface and a second surface, said vehicle arresting means of said barricade being connected to the proximal end of the second surface and extending outwardly therefrom for arresting the undesired vehicle.

12. An apparatus as defined in claim 11, wherein said vehicle arresting means comprises a vehicle piercer for piercing through at least an outer surface of the undesired vehicle so as to stop the forward progression of the undesired vehicle through said barricade.

13. A vehicle security gate apparatus for inhibiting undesired access to a protected area, the apparatus comprising:

a barricade adapted to be positioned adjacent a roadway to thereby block vehicle passage along the roadway into an area desired to be protected, said barricade including an elongate beam member defining a base and vehicle arresting means connected to and extending outwardly from said base for arresting an undesired vehicle attempting entrance into the protected area; and barricade rotating means connected to said barricade for readily rotating a portion of said barricade which blocks vehicle passage 360 degrees in opposing directions about a predetermined axis so that said barricade rotates about the predetermined axis in a first rotational direction between a vehicle blocking position which blocks the roadway so as to inhibit an undesired vehicle from readily entering into the protected area and a different vehicle passage position which allows a desired vehicle to readily pass along the roadway into the protected area and in a second rotational direction between the vehicle blocking position and a different vehicle arresting position which arrests an undesired vehicle with said vehicle arresting means of said barricade responsive to an attempt by the undesired vehicle to ram said barricade when said barricade is positioned in the vehicle blocking position, the predetermined axis extending generally parallel to the plane of the roadway which extends into the protected area.

14. An apparatus as defined in claim 13, wherein said barricade rotating means is connected to a medial portion of said barricade for rotating said barricade 360 degrees in opposing directions about the predetermined axis.

15. An apparatus as defined in claim 14, wherein the medial portion of the mounting of said barricade is a non-centered medial portion so that said barricade rotatingly rests in the vehicle blocking position, and wherein the connecting of said barricade to said barricade rotating means balances said barricade in at least the vehicle passage and the vehicle blocking positions so as to enhance manual operation of said barricade during rotation of said barricade between the vehicle blocking and vehicle passage positions.

16. An apparatus as defined in claim 13, wherein a distal end of said barricade rotates in the second rotational direction outwardly away from a vehicle during an attempt to ram said barricade when said barricade is in the vehicle blocking position and the proximal end of said barricade responsively rotates inwardly into contact with corresponding proximal portions of the undesired vehicle attempting to ram said barricade to thereby arrest the undesired vehicle.

17. An apparatus as defined in claim 16, wherein said base of said barricade has a first substantially flat surface and a second surface, said vehicle arresting means of said barricade being connected to the proximal end of the second surface and extending outwardly therefrom for arresting the undesired vehicle.

18. An apparatus as defined in claim 17, wherein said vehicle arresting means comprises a vehicle piercer for piercing through at least an outer surface of the undesired vehicle so as to stop the forward progression of the undesired vehicle through said barricade.

19. An apparatus as defined in claim 17, further comprising a pit formed in the roadway into the protected area, said barricade rotating means being mounted to said pit so that at least portions of said base of said barricade readily rotate into and out of said pit, and wherein said pit and said base are each at least relatively narrower than the lateral distance between each of the two pairs of tires of a compact vehicle so that each of the two pair of tires of the compact vehicle can readily pass over said pit and said base when said barricade is positioned in the vehicle passage position.

20. A vehicle security gate apparatus for inhibiting undesired access to a protected area, the apparatus comprising:

a barricade adapted to be positioned adjacent a roadway to thereby block vehicle passage along the roadway into an area desired to be protected; and barricade rotating means connected to said barricade for rotating said barricade about a predetermined axis so that said barricade rotates about the predetermined axis between a vehicle passage position which allows a desired vehicle to readily pass along the roadway into the protected area, a vehicle blocking position which blocks the roadway so as to inhibit an undesired vehicle from readily entering into the protected area, and a vehicle arresting position which arrests an undesired vehicle responsive to an attempt by the undesired vehicle to ram said barricade when said barricade is positioned in the vehicle blocking position, said barricade rotating means being connected to a medial portion of said barricade for rotating said barricade 360 degrees in opposing directions about the predetermined axis, the medial portion of the mounting of said barricade being a non-centered medial portion so that said barricade rotatingly rests in the vehicle blocking position, and wherein the connecting of said barricade to said barricade rotating means balances said barricade in at least the vehicle passage and the vehicle blocking positions so as to enhance manual operation of said barricade during rotation of said barricade between the vehicle blocking and vehicle passage positions.

21. A vehicle security gate apparatus for inhibiting undesired access to a protected area, the apparatus comprising:

a barricade including at least a base having an elongate shape and adapted to be positioned adjacent a roadway so that at least portions of the base thereby block vehicle passage along the roadway into an area desired to be protected and vehicle arresting means connected to the base for arresting an undesired vehicle attempting to ram said barricade, the base of said barricade comprising an elongate beam member having a first substantially flat surface and a second surface, said vehicle arresting means of said barricade having a triangular-shaped beam member which includes a pointed tip thereof, said triangular-shaped beam member being connected to the second surface of the elongate beam member and extending outwardly therefrom for arresting the undesired vehicle; and barricade rotating means connected to a medial portion of the base of said barricade for rotating a portion of the base of said barricade which blocks vehicle passage about a predetermined axis so that the base of said barricade readily rotates 360 degrees in opposing directions about the predetermined axis between a vehicle passage position which allows a desired vehicle to readily pass along the roadway into the protected area, a vehicle blocking position which blocks the roadway so as to inhibit an undesired vehicle from readily entering into the protected area, and a vehicle arresting position which arrests an undesired vehicle responsive to an attempt by the undesired vehicle to ram said barricade when the base of said barricade is positioned in the vehicle blocking position, and wherein the connecting of said barricade to said barricade rotating means balances the base of said barricade in at least the vehicle passage and the vehicle blocking positions so as to enhance operation of said barricade during rotation of the base of said barricade between the vehicle blocking and vehicle passage positions.

22. A vehicle security gate apparatus for inhibiting undesired access to a protected area, the apparatus comprising:

a barricade adapted to be positioned adjacent a roadway to thereby block vehicle passage along the roadway into an area desired to be protected, said barricade including an elongate beam member defining a base, said base having a substantially flat surface and a second surface, and vehicle arresting means connected to and extending outwardly from the second surface of said base for arresting an undesired vehicle attempting entrance into the protected area;

barricade rotating means connected to said barricade for readily rotating a portion of said barricade which blocks vehicle passage 360 degrees in opposing directions about a predetermined axis so that said barricade rotates about the predetermined axis in a first rotational direction between a vehicle blocking position which blocks the roadway so as to inhibit an undesired vehicle from readily entering into the protected area and a different vehicle passage position which allows a desired vehicle to readily pass along the roadway into the protected area and in a second rotational direction between the vehicle blocking position and a different vehicle arresting position which arrests an undesired vehicle with said vehicle arresting means of said barricade responsive to an attempt by the undesired vehicle to ram said barricade when said barricade is positioned in the vehicle blocking position, and a pit formed in the roadway into the protected area, and wherein said barricade rotating means is mounted to said pit so that at least portions of said elongate beam member readily rotate into and out of said pit, and wherein said pit and said elongate beam member are each at least relatively narrower than the lateral distance between each of the two pairs of tires of a compact vehicle so that each of the two pairs of tires of the compact vehicle can readily pass over said pit and said elongate beam when said barricade is positioned in the vehicle passage position.

* * * * *